US005713768A

United States Patent [19]

Jones

[11] Patent Number: 5,713,768

[45] Date of Patent: Feb. 3, 1998

[54] INTAKE HOUSING FOR PERSONAL WATERCRAFT

[75] Inventor: James R. Jones, Neosho, Wis.

[73] Assignee: Brunswick Corp., Lake Forest, Ill.

[21] Appl. No.: 710,868

[22] Filed: Sep. 23, 1996

[51] Int. Cl.[6] ..... B63H 11/00

[52] U.S. Cl. ..... 440/38; 440/42; 440/89

[58] Field of Search ..... 60/220, 221; 440/38, 440/39, 40, 41, 47, 42, 46, 89; 114/270

[56] References Cited

U.S. PATENT DOCUMENTS

| | | | |
|---|---|---|---|
| 3,982,497 | 9/1976 | Caron | 114/270 |
| 4,631,032 | 12/1986 | Nishida | 440/47 |
| 4,768,983 | 9/1988 | Smith | 440/111 |
| 4,813,898 | 3/1989 | Nakase et al. | 440/111 |
| 4,984,528 | 1/1991 | Kobayashi | 114/270 |
| 5,152,704 | 10/1992 | Carlson | 440/38 |
| 5,203,728 | 4/1993 | Kobayashi | 440/38 |
| 5,536,187 | 7/1996 | Nanami | 440/38 |

*Primary Examiner*—Stephen Avila

*Attorney, Agent, or Firm*—Andrus, Sceales, Starke & Sawall

[57] ABSTRACT

A personal watercraft jet propulsion system has a hull design and an intake housing to optimize the structural integrity of the hull, and facilitate efficient installation of the jet propulsion system without sacrificing proper alignment of the components of the jet propulsion system. The watercraft hull includes a recess defined by an inclined bulkhead spanning between two substantially vertical sidewalls. The inclined bulkhead contains an opening between the engine compartment within the hull and the components of the jet propulsion system. The intake housing mounts to the inclined bulkhead to cover the opening. The intake housing has coplanar mounting surfaces surrounding the opening in the bulkhead. Proper alignment of the pump components requires only that the intake housing be mounted properly to the inclined bulkhead. Structural integrity of the hull is maintained because access into the engine compartment for many pump components external of the hull is provided through the intake housing and the opening in the inclined bulkhead, rather than through additional apertures in the hull.

24 Claims, 4 Drawing Sheets

FIG. 5
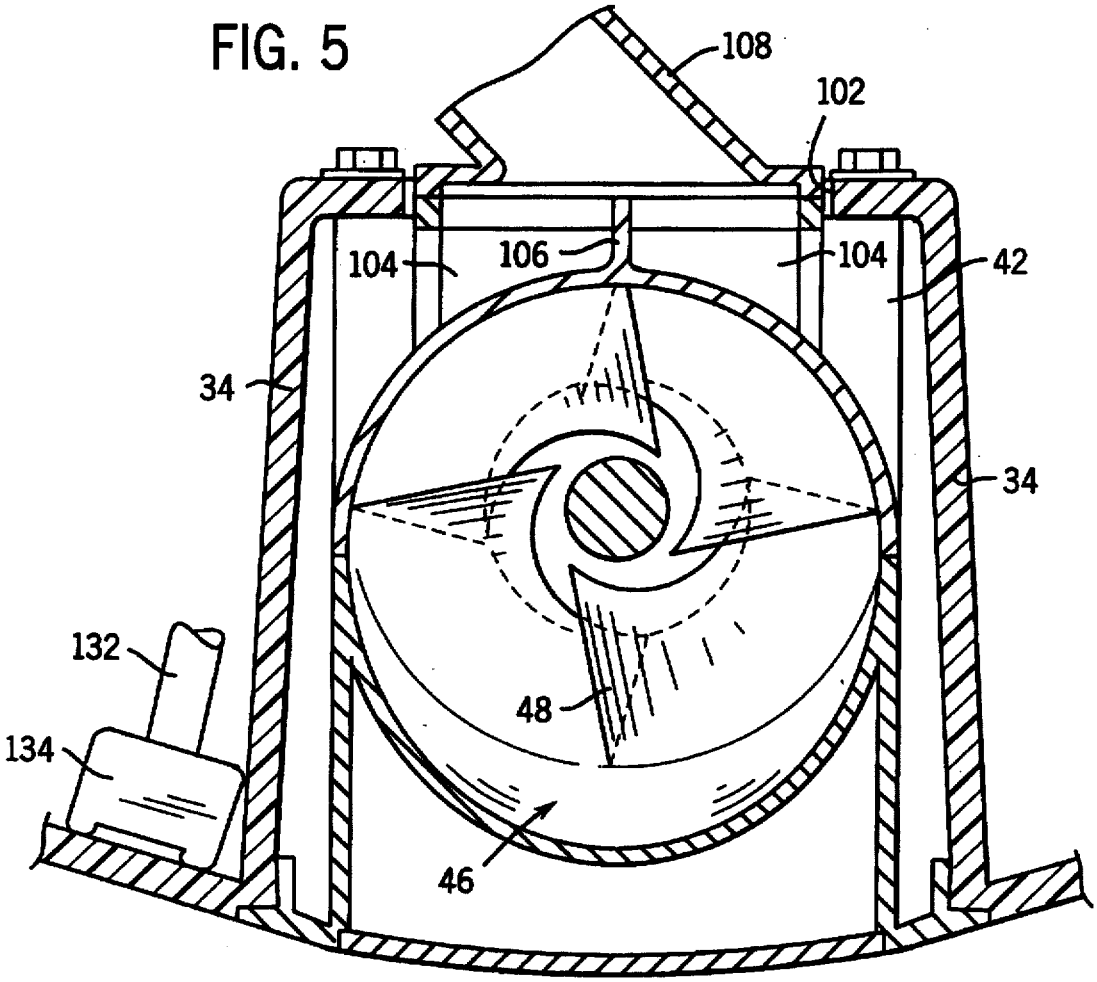
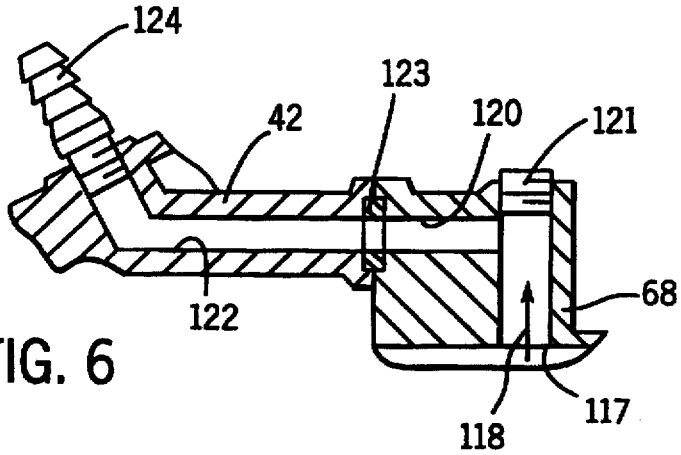
FIG. 6

INTAKE HOUSING FOR PERSONAL WATERCRAFT

FIELD OF THE INVENTION

The invention relates to jet propulsion systems for personal watercraft. In particular, the invention relates to an intake housing for the jet propulsion system that facilitates efficient installation of the system.

BACKGROUND OF THE INVENTION

Jet drives for personal watercraft typically have an engine driven jet pump located within a duct in the hull of the watercraft. An inlet opening through the underside of the watercraft allows sea water to flow to the pump in the duct. An inlet adapter is typically used to adapt the intake housing to the hull on the bottom of the watercraft. The inlet adapter closes off the bottom of the watercraft yet allows sea water to pass through the inlet opening into the inlet duct and to the pump. The inlet adapter usually has a screen, grate or tines to keep debris from flowing through the inlet opening into the pump. An intake housing or pump casing is typically used to provide a gradually sloping inlet duct from the inlet adapter to the jet pump. The jet pump generally consists of an impeller and a stator located within the duct followed by a nozzle. The impeller of the pump is driven by the engine, and provides energy to the flow of sea water to the pump. From the impeller, the sea water flows through the stator and the nozzle before exiting rearward through a vectored outlet to steer the watercraft (e.g., a generally tubular rudder that can rotate to steer the watercraft).

An impeller drive shaft passes through an opening in the intake housing and through the intake duct in the inlet housing to the hub of the impeller. One or more sealed bearings support the impeller drive shaft for rotation in the shaft opening through the intake housing. The hub of the impeller is rotatably mounted on beatings in the hub of the stator. The performance of the pump depends in large part on the alignment of the impeller within the pump. It is therefore critical, when mounting the intake housing, that the intake housing be properly positioned, and sufficiently secured.

The hull and transom in a personal watercraft are made of fiber reinforced plastic, and at least the lower portion of the transom is normally integral with the main portion of the hull. Installation of the jet propulsion system normally involves cutting or otherwise providing a hole through the bottom of the hull and also cutting or providing other holes through the transom. The inlet housing is usually cast aluminum, and is mounted to the hull so that the intake duct in the intake housing communicates with the opening through the bottom of the hull and the nozzle extending rearward. The inlet housing and pump components create substantial forces and vibrations that can compromise the integrity of the hull and transom over time. Providing several apertures in the hull tends to accelerate deterioration of the hull, and also presents additional sealing requirements.

Some personal watercraft provide a recess in the hull for the inlet and other pump components. An opening is provided through the hull for the impeller shaft. Recess systems normally include a flexible seal system that is used to seal the impeller shaft as it passes through the hull. A ride plate covers the recess underneath the pump and rearward of the inlet opening.

As mentioned above, it is important that the impeller drive shaft, the intake housing and the remainder of the pump components be properly aligned for optimum pump performance. In conventional personal watercraft, even those with hull recesses and vertical bulkheads for mounting the jet pump, installing the pump in proper alignment is often difficult. It normally involves matching the pump along two or three mounting planes when installing the pump to the watercraft hull.

SUMMARY OF THE INVENTION

The invention is a personal watercraft having an intake housing that is efficient to install without compromising proper alignment of pump components.

In one aspect, the invention is a personal watercraft in which an intake housing is mounted to an inclined bulkhead within a recess in the hull. The recess in the hull is preferably defined by an inclined, planar bulkhead wall and two vertical sidewalls extending rearward from the inclined bulkhead wall. A top recess wall can be provided rearward of the inclined bulkhead wall from the top of the bulkhead wall to the transom of the watercraft. The inclined bulkhead contains an opening. The intake housing is mounted to the inclined bulkhead to cover the opening. The intake housing preferably has inclined, coplanar mounting surfaces that correspond to the inclined bulkhead. The coplanar or mounting surfaces on the intake housing surround the opening through the inclined bulkhead. The intake housing is thus mounted externally of the hull. Other components of the jet propulsion system are preferably mounted to the intake housing, not to the fiberglass hull.

The intake housing includes an impeller drive shaft opening that is positioned in a location corresponding to the location of the opening in the inclined bulkhead when the intake housing is mounted to the hull of the watercraft. The impeller drive shaft thus passes through the opening in the inclined bulkhead, through the impeller drive shaft opening, and through the intake duct in the inlet housing as the impeller drive shaft extends towards the pump impeller. A sealed impeller drive shaft beating assembly preferably supports the impeller drive shaft as it extends through the shaft opening in the intake housing.

In another aspect, the intake housing also preferably has an exhaust opening positioned in a location corresponding to the location of the opening in the bulkhead. An exhaust passage through the intake housing extends from the exhaust opening to an opening rearward of the intake housing. The exhaust passage is preferably separate from the intake duct through the intake housing. An exhaust adapter is preferably mounted to the intake housing around the exhaust opening. The exhaust adapter extends from the intake housing through the opening in the bulkhead. The preferred exhaust adapter has an exhaust inlet that receives exhaust from the engine of the watercraft, and a spent cooling water inlet that receives spent cooling water from the engine of the watercraft. A personal watercraft in accordance with the invention preferably also has an engine cooling water supply system plumbed through the intake housing, a bilge bailing system plumbed through the intake housing, and a steering control cable mounted through the intake housing. (It may also be possible to pass other system components through the intake housing, e.g., shift or trim cables.) Passing system components through the aluminum intake housing, rather than the fiberglass hull maintains the structural integrity of the watercraft hull, and provides robust sealing of thru-hull features.

A primary object of the invention is to provide a jet propulsion system that can be mounted to the watercraft without substantially compromising the structural integrity of the reinforced plastic watercraft hull. The invention accomplishes this objective by preferably mounting the intake housing over a single opening in an inclined bulkhead in a recess in the hull, thus providing access between the engine compartment inside the hull to the external components of the jet propulsion system through the cast aluminum intake housing rather than through the hull. In the preferred watercraft, system components for the impeller drive, engine exhaust, engine cooling, bilge bailing and steering, pass through the aluminum intake housing rather than the fiberglass hull.

Another primary object of the invention is to facilitate efficient installation and removal of the pump assembly without compromising proper alignment of pump components. The invention accomplishes this object by providing an inclined bulkhead surface to which the intake housing is mounted, and securing the remaining pump components to the intake housing without securing the components to the hull at another location. Since the intake housing and the remaining pump components are mounted to the hull along the inclined bulkhead surface only, precise alignment of the components can be obtained by properly matching along the inclined bulkhead only, rather than along two or three mounting planes as is typically done in the prior art.

Other features and advantages of the invention may be apparent to those skilled in the art upon reviewing the following drawings and description thereof.

BRIEF DESCRIPTION OF THE DRAWINGS

FIG. 5 is a view taken along lines 5—5 in FIG. 4.

FIG. 6 is detailed view showing an engine cooling water intake port in accordance with one aspect of the invention.

DETAIL DESCRIPTION OF THE DRAWINGS

Figure 1:
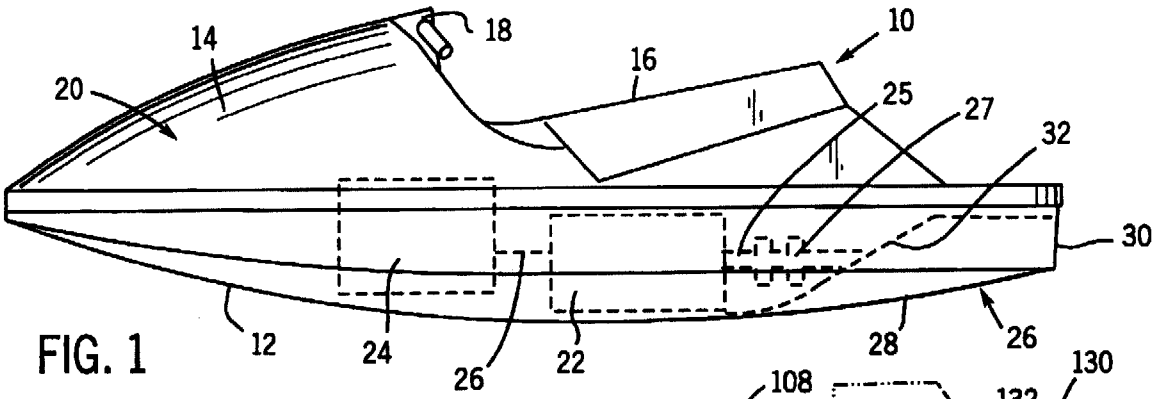
FIG. 1 is a schematic drawing illustrating a personal watercraft.

FIG. 1 shows a personal watercraft 10. The personal watercraft has hull 12 and a deck 14, both preferably made of fiber reinforced plastic. A driver and/or passenger riding on the watercraft 10 straddles the seat 16. The driver steers the watercraft using a steering assembly 18 located forward of the seat 16.

An engine compartment 20 is located between the hull 12 and the deck 14. A gasoline fueled internal combustion engine 22 is located within the engine compartment. A fuel tank is located forward of engine 22 within the engine compartment 20. The engine 22 receives fuel from the fuel tank 24 through fuel line 26. The engine 22 has an output shaft 25 that is coupled to a jet pump located rearward of the engine 22 generally in the vicinity shown by arrow 26. More specifically, the engine output shaft 25 is coupled to an impeller drive shaft 27 for the pump.

The aft of the hull 12 has a bottom portion 28, and a substantially vertical transom 30 at the stem of the watercraft 10. A longitudinal recess 32 is located along the centerline of the hull 12. The recess 32 extends upward from the bottom 28 of the hull 12, and rearward to the transom 30.

Referring now to FIGS. 2–5, the recess 32 is defined by an inclined, planar bulkhead wall 36 and two substantially vertical sidewalls 34 extending rearward from the inclined bulkhead wall 36 to the transom 30 (FIG. 5). A substantially horizontal top recess wall 38 extends rearward from the top of the inclined bulkhead wall 36 and spans between the top of the two sidewalls 34 rearward of the inclined bulkhead wall 36. An opening 40 is contained entirely through the inclined bulkhead wall 36.

In accordance with the invention, the jet propulsion system 26 includes an aluminum intake housing 42 that is mounted to the fiber reinforced plastic hull 12 so that the intake housing 42 covers the opening 40 in the inclined bulkhead wall 36 in the hull recess 32. The intake housing 42 is preferably made of die-cast aluminum. The intake housing 42 has an inlet opening 44 that provides a path for sea water to flow into an intake duct 46 located within the intake housing 42. Sea water flows upward and rearward through the intake duct 46 to an impeller 48. The impeller 48 is rotatably driven by the impeller drive shaft 27. The impeller drive shaft 27 passes through an impeller drive shaft opening 52 in the intake housing 42, and is rotatably supported by a sealed bearing assembly 54. The sealed bearing assembly 54 includes a roller bearing **54*a* located in a lubrication chamber 54*b*. The lubrication chamber 54*b* is filled with lubricant such as grease. Seals 54*c* and 54*d* are located around the impeller shaft 27 to seal the lubrication chamber 54*b*. A sleeve 54*e* forms the outer portion of the lubrication chamber 54*b*, and secures the roller bearing 54*a* in place. External to the intake housing 42, a coupling head 56 is threaded onto the impeller drive shaft 27. The coupling head 56 is preferably driven by the coupler 50 through an elastomeric member 58, although other coupling techniques can be used in accordance with the invention. The preferred coupler 50, elastomeric member 58, and impeller coupling head 56** are disclosed in detail in copending patent application Ser. No. 08/735,325 entitled "Engine Drive Shaft Coupler For Personal Watercraft", by Jerry Hale and assigned to the assignee of the present application, which is herein incorporated by reference.

The intake housing 42 has inclined, coplanar mounting surfaces 60 which correspond to the inclined planar bulkhead wall 36 of the hull recess 32. The coplanar mounting surfaces 60 completely surround the opening in the inclined bulkhead wall 36 in the hull recess 32. Bolts 62 secure the coplanar mounting surfaces 60 of the intake housing 42 against the inclined bulkhead wall 36. A sealant 64, also completely surrounding the opening 40 in the inclined bulkhead wall 36, is located between the inclined bulkhead wall 36 of the hull recess 32 and the inclined, coplanar mounting surfaces 60 of the inlet housing 42.

The mounting of intake housing 42 to the hull occurs along a single mounting plane. Therefore, matching or registering along only one mounting plane is required to achieve proper alignment of pump components. This facilitates efficient and precise installation of the intake housing 48 and also the other pump components.

Figure 2:
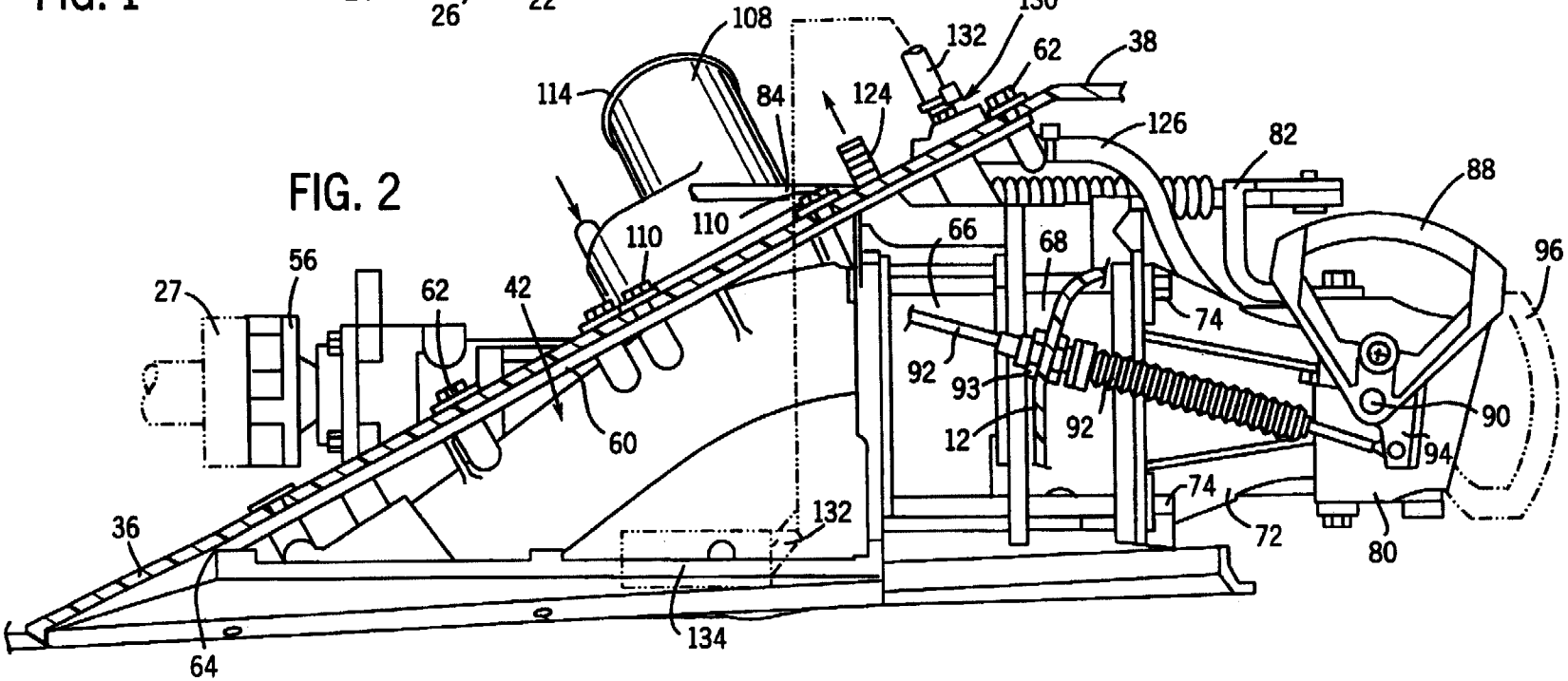
FIG. 2 is a side view of a jet pump assembly for propelling the watercraft shown in FIG. 1, which has an intake housing in accordance with the invention.

The impeller 48 rotates within a wear ring 66. The wear ring is mounted to the intake housing 42 rearward of the inlet duct 46. A stator 68 is mounted rearward of the wear ring 66. The impeller 48 is supported by a journal bearing 70 in the hub or torpedo 78 in the stator 68. A nozzle 72 is mounted rearward of the stator 68. The wear ring 66, the stator 68, and the nozzle 72 are mounted to the intake housing 42 using attachment bolts or mounting studs 74 (FIG. 2). The peripheral edge of the intake housing 42, the wear ring 66, the stator 68, and the nozzle 70, each include corresponding alignment seats or ridges. The mounting studs 74 extend through outer flanges in the wear ring 66, the stator 68, and the nozzle 72, and thread into threaded openings in the intake housing 42.

The impeller 48 accelerates sea water flowing through the intake housing 42 as the impeller 48 rotates within the wear ring 66. The stator 68 has several stationary vanes 76, preferably seven (7) vanes, to remove swirl from the accelerated sea water. The preferred stator 68 is disclosed in detail in copending patent application Ser. No. 08/710,869 entitled "Stator And Nozzle Assembly For Jet Propelled Personal Watercraft", by James R. Jones, and assigned of present invention, which is herein incorporated by reference. The flow area through the upstream portion of the stator 68 is preferably constant, but decreases continuously through the aft portion of the stator 68 and through the nozzle 72. Sea water thus increases speed as the water flows through the stator 68 and the nozzle 72.

Sea water exiting nozzle 72 can be directed by rotating rudder 80 about a vertical axis to steer the personal watercraft 10. Rudder 54 is rotated by actuating steering arm 82. A steering control cable 84 is connected to the rudder steering arm 82 and can be moved to actuate the steering arm 82. The intake housing 42 includes a cable support passage 86 through which the steering control cable 84 passes. The steering control cable 84 is allowed to slide axially through the cable support passage 86, however, the cable support passage 86 prevents the steering control cable 84 from having non-axial movement. Preventing axial and non-axial misalignment is important for the steering performance of the watercraft 10 and supporting the steering control cable 84 through the cable support passage 86 in the aluminum intake housing 42 is a particularly effective and durable way of preventing axial and non-axial misalignment of the cable 84. Passing the cable support passage 86 through the aluminum intake housing 112 also eliminates the need to pass the steering control cable 84 through an additional aperture in the fiber reinforced plastic hull.

A reverse bucket 88 is mounted to the rudder 80 along a horizontal axis 90, FIG. 2. A reverse control cable 92 is connected to flange 94 on the reverse bucket 88. The reverse bucket 88 can be moved into a down or reverse position 96 (illustrated in phantom in FIG. 2) by pulling on the reverse control cable 92. In a similar fashion, the reverse bucket 88 can be raised by pushing the reverse control cable 92 rearward.

With the embodiment of the invention shown in FIGS. 2–5, the reverse bucket control cable 92 passes through the hull 12, FIG. 2, as the control cable 92 passes from the engine compartment rearward of the watercraft to the reverse bucket 88. A threaded fitting 93 provides stability for reverse bucket control cable 92 as it passes through the hull 12. Although the embodiment of the invention shown in FIGS. 2–5 does not provide a passage for the reverse control cable 92 (and/or a trim control cable) through the inlet housing 42, such a passage through the inlet housing 42 is considered to be within the scope of the invention.

An inlet adapter plate 98 is connected to the intake housing 42 upstream of the intake duct 46 to adapt the intake housing 42 to the hull 12 on the bottom of the watercraft 10. A tine assembly 100 has a plurality of tines that extend rearward from the inlet adapter 98 to cover the inlet opening 44. A ride plate 102 is mounted to the inlet adapter 98 rearward of the inlet opening 44. The ride plate 102 covers the area rearward of the inlet opening 44 rearward to the transom 30 so that the pump components are not exposed. The ride plate 102 is supported in part by a depending boss 103 on the nozzle 72. The preferred inlet adapter system, including the inlet adapter plate 98, the tine assembly 100, and the ride plate 102, are disclosed in detail in patent application Ser. No. 08/717,915, entitled "Inlet Adaptor For A Personal Watercraft", by James R. Jones, and assigned to the assignee of the present application, which is herein incorporated by reference.

It may be apparent to those skilled in the art that the invention as described thus far is particularly well suited for efficient and accurate installation. Not only does the inclined bulkhead surface 36 require that only one surface be matched to obtain proper registration for alignment of the impeller drive shaft 50, but also the likelihood of the remaining pump components being properly aligned without sacrificing efficient installation is improved because the remaining pump components are mounted solely to the intake housing 42, either directly or indirectly. Removal of the pump assembly 26 can be accomplished easily by loosening mounting bolts 62 from inside the engine compartment 20, and detaching certain cables and tubes. Easy removal of the pump assembly is facilitated by the manner in which the coupler 50 interacts with the coupling head 56.

Referring still to FIGS. 2 through 5, the intake housing 42 includes an exhaust opening 102 having a location corresponding to the location of the opening 40 in the inclined bulkhead wall 36 in the hull recess 32. The intake housing 42 also has an exhaust passage 104 that provides an exhaust flow path from the exhaust opening 102 of the intake housing rearward of the intake housing 42. The exhaust passage 104 is separate from the intake duct 46. FIG. 5 shows a structural support wall 106 separating the exhaust passage 104 into two separate compartments.

An exhaust adapter 108 is attached to the intake housing 42 around the exhaust opening 102. Fasteners such as bolts 110 are used to fasten the exhaust adapter to the intake housing 42. The exhaust adapter 108 extends from the intake housing 42 through the opening 40 in the inclined bulkhead wall 36 of the hull recess 32. The exhaust adapter has an exhaust inlet 112 that receives exhaust from the engine 22 of the watercraft 10, preferably from a flexible exhaust tube after the exhaust has passed through a muffler. The exhaust adapter 108 includes a flared exhaust inlet rim 114 around the exhaust inlet 112 to facilitate attachment of an exhaust tube to the exhaust adapter 108. The exhaust adapter 108 also has a spent cooling water inlet 116 that receives cooling water from the engine 22 after the cooling water has circulated through the engine 22. Typically, a tube or hose from the engine 22 supplies spent cooling water from the engine 22 to the spent cooling water inlet 16 on the exhaust adapter 108. Exhaust and spent cooling water are mixed together within the exhaust adapter 108 and are discharged through the exhaust passage 104 in the intake housing 42 and rearward of the intake housing 42 through the transom 30 of the watercraft 10.

The watercraft 10 includes an engine cooling water supply system that does not require a separate pump for circulating cooling water through the engine 22. Referring now to FIGS. 2 and 6 and in particular to FIG. 6, the cooling water supply system has a cooling water inlet port 117 that is plumbed through the outer housing of the stator 68. Water passing through the stator 68 has a relatively high pressure, and therefore naturally exits through cooling water intake port 117 through a passageway 120 in the direction of arrow 118 without the use of a dedicated cooling water pump. Plug 121 is provided to seal passageway 120. Cooling water passes through one passageway 120 in the stator housing 68 into a passageway 122 in the inlet housing 42. An O-ring seal 123 seals around the junction of the passageways 122 and 123 between the stator housing and the intake housing 42. A fitting 124 having a hollow longitudinal axis is screwed into passageway 122 in the intake housing. A hose or tube (not shown) is attached to fitting 124 and transports cooling water from the cooling water passage 122 in the intake housing to the engine 22. The cooling water circulates the engine 22 and returns to the spent cooling water inlet 116 on the exhaust adapter 108.

Referring again to FIGS. 2 through 5, the watercraft 10 also includes a bilge bailing system. The bilge bailing system uses a venturi effect created in the nozzle 72 to siphon standing water from the bilge of the hull 12. A siphoning tube 126 is plumbed into the nozzle 72 at a siphon outlet opening 128, FIG. 4. The intake housing 42 includes a siphoning passage in the vicinity of arrow 130. The siphoning passage 130 in positioned housing 42 is positioned at a location corresponding to the location of the hole 40 in the inclined bulkhead wall 36 of the hull recess 32. The siphoning tube 126 connects to the siphoning passage 130 in the intake housing 42. A bailing tube 132 connects to the siphoning passage of the intake housing from within the engine compartment 20 of the watercraft 10. The bailing tube 132 extends from the siphoning passage in the intake housing to a low spot in the bilge of the watercraft. A siphon brake is provided in the bailing tube 132 to prevent the watercraft 10 from inadvertent flooding when the watercraft 10 is at rest. FIG. 5 shows the bailing tube 132 terminating at a bilge member 134 having a screened opening which is placed in a low spot of the bilge within the hull 12. The bilge bailing system provides suction at the screen 134 to remove water at screen 134 from the bilge through the bailing tube 132, through the siphoning passage 130 in the intake housing 42, and through the siphoning tube 126 into the flow of propelled water through the nozzle 72.

Figure 3:
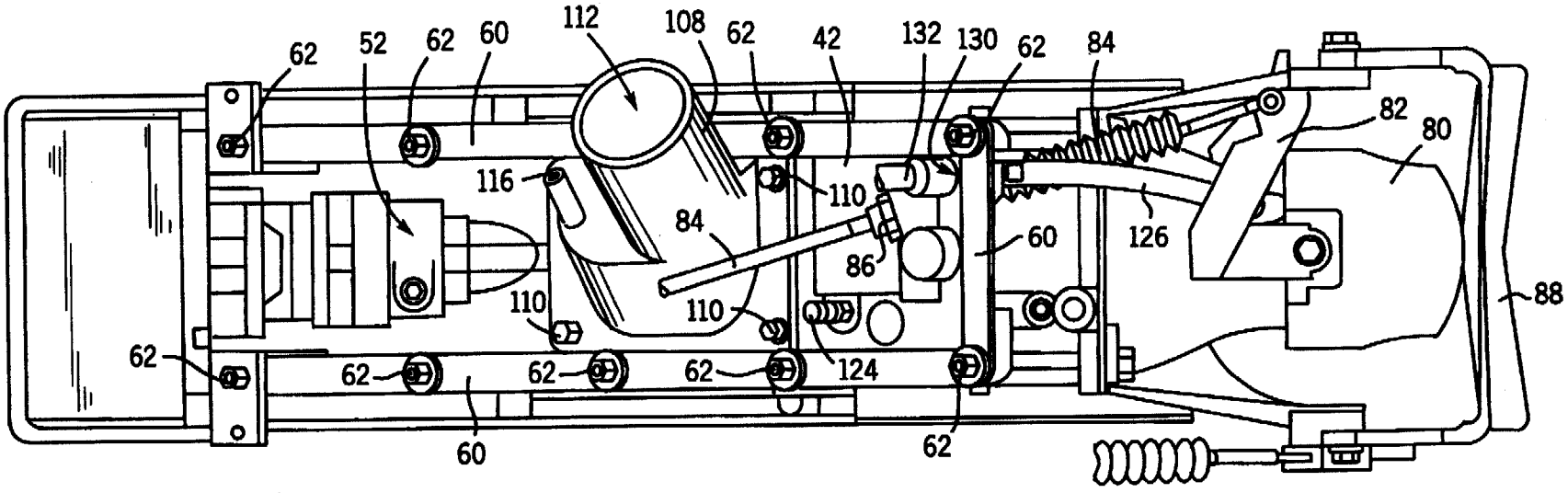
FIG. 3 is a top view of the jet pump assembly shown in FIG. 2, which has an intake housing in accordance with the invention.
Figure 4:
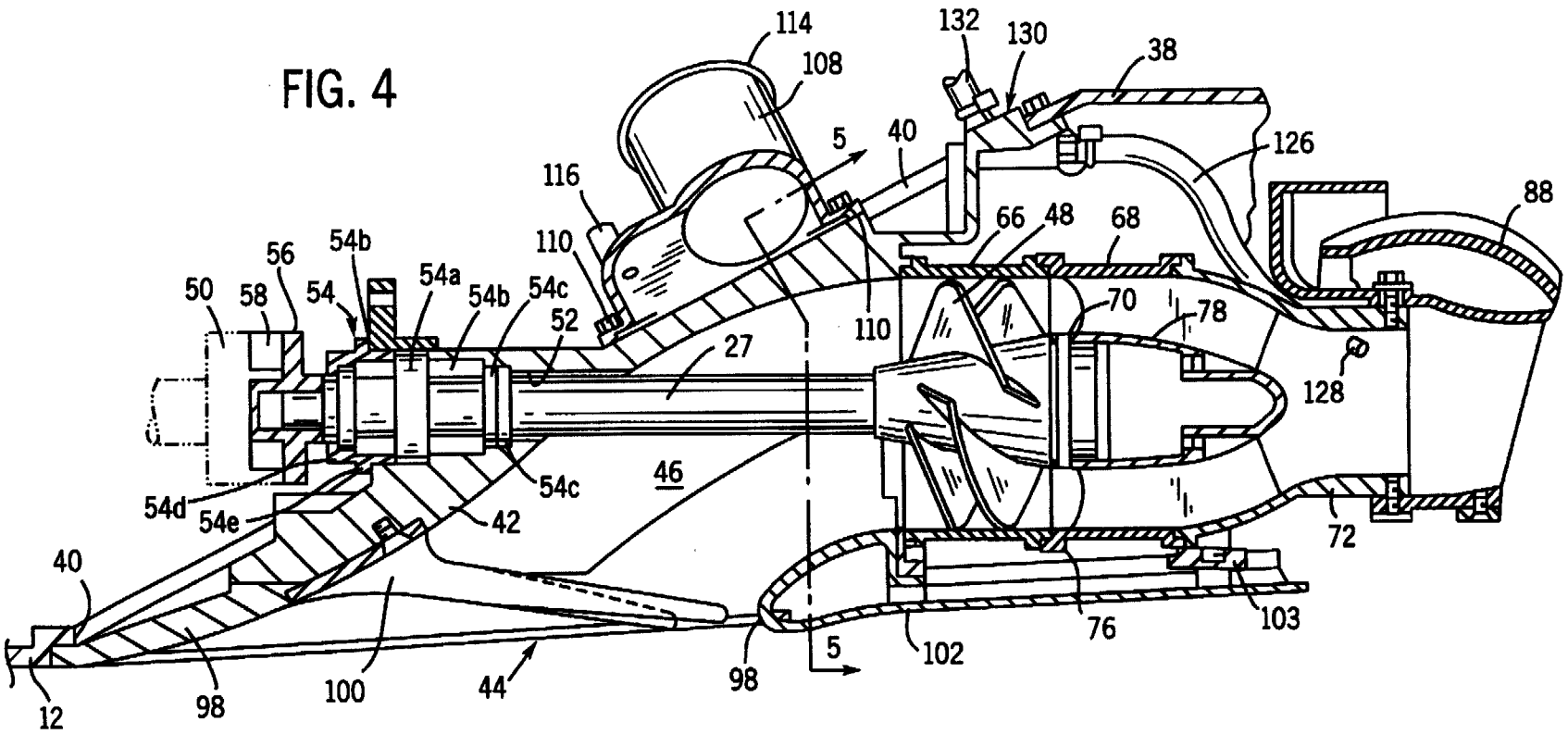
FIG. 4 is a sectional view of the jet pump shown in FIG. 2 showing an intake housing in accordance with the invention.

Referring in particular to FIG. 3, the configuration of the intake housing 42 provides access into the engine compartment 20 for many of the subsystems necessary to operate the jet propulsion system of the watercraft 10. FIG. 3 shows clearly that the impeller drive shaft opening 52, the exhaust opening 102 and the exhaust adapter 108, the engine cooling water supply 124 and return 116, the bilge bailing tube 132, and the steering control cable 84 all pass through the intake housing 42 in the area within the coplanar mounting surfaces 60. As discussed previously, the opening 40 in the inclined bulkhead wall 36 of the hull recess 32 corresponds to the area within the coplanar mounting surfaces 60 on the intake housing 42. Thus, for the above-listed components, it is necessary to cut only one opening in the hull. Further, the coplanar mounting surfaces 60 on the intake housing 42 provide a structurally stable mounting base.

The configuration of intake housing 42 therefore minimizes the amount in which the structural integrity of the hull 12 is compromised because it reduces the number of openings that must be provided through the hull 12.

It is recognized that various alternatives and modifications of the invention are possible in accordance with the true spirit of the invention. Such modifications or alternatives should be considered to be within the scope of the following claims.

I claim:

1. A jet propelled watercraft comprising:

a pump having an impeller and a stator;

an inlet opening through the underside of the watercraft that allows sea water to flow to the pump;

a vectored outlet that allows sea water to flow from the pump rearward of the watercraft after the impeller has provided energy to the flow of sea water through the pump;

a hull having a bottom, a transom, and a longitudinal recess extending from the bottom of the hull to the transom, the recess being defined at least in part by an inclined bulkhead wall, wherein an opening is provided through the hull within the longitudinal recess;

an intake housing mounted to the hull to cover the opening in the inclined bulkhead wall, the intake housing providing an intake duct through which sea water flowing through the inlet opening in the underside of the watercraft flows to the pump impeller, and wherein the inclined bulkhead wall is planar and the inlet housing has inclined, coplanar mounting surfaces corresponding to the inclined bulkhead wall of the hull, said coplanar mounting surfaces completely surrounding the opening in the hull.

2. A watercraft as recited in claim 1 wherein:

the longitudinal recess is defined by the inclined bulkhead wall and two vertical sidewalls extending rearward from the inclined bulkhead wall to the transom; and the opening in the longitudinal recess is contained entirely through the inclined bulkhead wall.

3. A watercraft as recited in claim 2 wherein the intake housing is mounted to the inclined bulkhead wall of the hull using fasteners that circumscribe the opening in the hull.

4. A watercraft as recited in claim 3 further comprising means for sealing completely surrounding the opening in the hull and located between the inclined bulkhead wall of the hull and the inclined, coplanar mounting surfaces of the intake housing.

5. A watercraft as recited in claim 1 wherein:

the pump impeller is rotated by an impeller drive shaft that is coupled to an output shaft of an engine for the watercraft; and the intake housing includes an impeller drive shaft opening having a location corresponding to the location of the opening in the hull so that the impeller drive shaft passes through the opening in the hull, through the impeller drive shaft opening, and through the intake duct of the intake housing as the impeller drive shaft extends towards the pump impeller.

6. A watercraft as recited in claim 5 wherein the intake housing further comprises an impeller drive shaft bearing assembly that rotatably supports the impeller drive shaft as the impeller drive shaft extends through the impeller drive shaft opening in the intake housing.

7. A watercraft as recited in claim 1 wherein the intake housing includes:

an exhaust opening having a location corresponding to the location of the opening in the hull; and an exhaust passage providing an exhaust flow path from the exhaust opening rearward of the intake housing, the exhaust passage being separate from the intake duct.

8. A watercraft as recited in claim 7 further comprising an exhaust adapter that attaches to the intake housing around the exhaust opening, and extends from the intake housing through the opening in the hull.

9. A watercraft as recited in claim 8 wherein the exhaust adapter has an exhaust inlet for receiving exhaust from an engine for the watercraft, and a spent cooling water inlet for receiving spent cooling water from the engine of the watercraft.

10. A watercraft as recited in claim 1 wherein the watercraft includes an engine cooling water supply system comprising:

a cooling water intake port plumbed through a housing for the stator;

a cooling water passage through the intake housing;

a first tube for transporting water from the cooling water port on the stator housing to the cooling water passage through the intake housing; and a second tube for transporting water from the cooling water passage through the intake housing to an engine for the watercraft.

11. A watercraft as recited in claim 1 wherein the watercraft includes an engine cooling water supply system comprising:

a cooling water intake port plumbed through a housing for a stator;

a cooling water passage through the inlet housing;

means for transporting high pressure water from the cooling water inlet port on the stator housing to the cooling water passage through the intake housing; and means for transporting the high pressure water from the cooling water passage through the intake housing to an engine for the watercraft.

12. A watercraft as recited in claim 1 wherein the watercraft includes a bilge bailing system comprising:

a siphoning passage through the intake housing;

a siphoning tube plumbed into a nozzle located rearward of the stator and extending to the siphoning passage; and a bailing tube extending from the siphoning passage through the intake housing to a low spot in the bilge of the watercraft.

13. A watercraft as recited in claim 1 wherein the watercraft has a steering mechanism comprising:

a nozzle located rearward of the stator;

a rudder mounted to the nozzle for rotation about a vertical axis;

a rudder steering arm for rotating the rudder about the vertical axis; and a steering control cable connected to the rudder steering arm and passing through a cable support passage through the intake housing.

14. A watercraft as recited in claim 1 wherein the watercraft has a reverse mechanism comprising:

a nozzle located rearward of the stator;

a rudder mounted to the nozzle for rotation about a vertical axis to steer the watercraft;

a reverse bucket mounted to the rudder for rotation about a horizontal axis; and a reverse control cable connected to the reverse bucket and passing through a cable support passage through the intake housing.

15. A jet propelled watercraft comprising:

a pump having an impeller and a stator;

an impeller drive shaft that rotates the pump impeller and is coupled to an output shaft for an engine for the watercraft;

an inlet opening through the underside of the watercraft that allows sea water to flow to the pump;

a vectored outlet that allows sea water to flow from the pump rearward of the watercraft after the pump impeller has provided energy to the flow of sea water through the pump, the vectored outlet including a rudder mounted for rotation about a vertical axis to steer the watercraft;

a steering cable connected to the rudder;

a hull having an opening;

an intake housing mounted to the hull to cover the opening, the intake housing providing an intake duct through which sea water flowing through the inlet opening in the underside of the watercraft flows to the impeller pump, and wherein the intake housing further includes:

an impeller drive shaft opening having a location corresponding to the location of the opening in the hull so that the impeller drive shaft passes through the opening in the hull, through the impeller drive shaft opening, and through the inlet duct of the intake housing as the impeller drive shaft extends towards the pump impeller, an exhaust opening having a location corresponding to the location of the opening in the hull, an exhaust passage providing an exhaust flow path from the exhaust opening rearward of the intake housing, the exhaust passage being separate from the intake duct, and a cable support passage through which the steering cable passes.

16. A watercraft as recited in claim 15 wherein the intake housing further comprises an impeller drive shaft bearing assembly that rotatably supports the impeller drive shaft as the impeller drive shaft extends through the impeller drive shaft opening in the intake housing.

17. A watercraft as recited in claim 15 further comprising an exhaust adapter that attaches to the intake housing around the exhaust opening and extends from the intake housing through the opening in the hull.

18. A watercraft as recited in claim 17 wherein the exhaust adapter has an exhaust inlet for receiving exhaust from the engine for the watercraft and a spent cooling water inlet for receiving spent cooling water from the engine of the watercraft.

19. A watercraft as recited in claim 15 further including an engine cooling water supply system comprising:

a cooling water intake port plumbed through a housing for the stator;

a cooling water passage through the intake housing;

a first tube for transporting water from the cooling water intake port on the stator housing to the cooling water passage through the intake housing; and a second tube for transporting water from the cooling water passage through the intake housing to an engine for the watercraft.

20. A watercraft as recited in claim 15 wherein the watercraft includes an engine cooling water supply system comprising:

a cooling water intake port plumbed through a housing for the stator;

a cooling water passage through the inlet housing;

means for transporting high pressure water from the cooling water intake port on the stator housing to the cooling water passage through the intake housing; and means for transporting the high pressure water from the cooling water passage through the intake housing to an engine for the watercraft.

21. A watercraft as recited in claim 15 wherein the watercraft includes a bilge bailing system comprising:

a siphoning passage through the intake housing;

a siphoning tube plumbed into a nozzle located rearward of the stator and extending to the siphoning passage; and a bail tube extending from the siphoning passage through the intake housing to a low spot in the bilge of the watercraft.

22. A watercraft as recited in claim 15 wherein the watercraft has a rudder outlet comprising:

a nozzle located rearward of the stator;

a rudder mounted to the nozzle for rotation about a vertical axis;

a rudder steering arm for rotating the rudder about the vertical axis; and a steering control cable connected to the rudder steering arm and passing through a cable support passage through the intake housing.

23. A watercraft as recited in claim 15 wherein the hull has a bottom, a transom, and a longitudinal recess in the hull extending from the bottom of the hull to the transom, the recess being defined at least in part by an inclined bulkhead wall having an opening therein.

24. A watercraft as recited in claim 15 wherein the watercraft has a reverse mechanism comprising:

a nozzle located rearward of the stator;

a rudder mounted to the nozzle for rotation about a vertical axis to steer the watercraft;

a reverse bucket mounted to the rudder for rotation about a horizontal axis; and a reverse control cable connected to the reverse bucket and passing through a cable support passage through the intake housing.

* * * * *